US006702546B2

(12) United States Patent
Takagi et al.

(10) Patent No.: US 6,702,546 B2
(45) Date of Patent: Mar. 9, 2004

(54) TURBINE FUEL PUMP

(75) Inventors: Masatoshi Takagi, Takahama (JP); Katsuhiko Kusagaya, Kariya (JP); Motoya Ito, Hekinan (JP); Yukio Mori, Nagoya (JP); Eiji Iwanari, Chiryu (JP)

(73) Assignee: Denso Corporation, Kariya (JP)

( * ) Notice: Subject to any disclaimer, the term of this patent is extended or adjusted under 35 U.S.C. 154(b) by 34 days.

(21) Appl. No.: 10/207,012

(22) Filed: Jul. 30, 2002

(65) Prior Publication Data

US 2003/0026685 A1 Feb. 6, 2003

(30) Foreign Application Priority Data

Jul. 31, 2001 (JP) ..... 2001-232749
Apr. 25, 2002 (JP) ..... 2002-124745

(51) Int. Cl.[7] ..... F04D 5/00
(52) U.S. Cl. ..... 415/55.1
(58) Field of Search ..... 415/55.1, 55.2–4, 415/55.5–7, 169.1

(56) References Cited

U.S. PATENT DOCUMENTS 6,082,984 A * 7/2000 Matsumoto et al. ..... 418/171
6,152,688 A * 11/2000 Staab et al. ..... 415/55.5

FOREIGN PATENT DOCUMENTS

JP 11-117890 4/1999

* cited by examiner

*Primary Examiner*—Edward K. Look
*Assistant Examiner*—J. M. McAleenan
(74) *Attorney, Agent, or Firm*—Nixon & Vanderhye P.C.

(57) ABSTRACT

A turbine fuel pump for smoothly flowing fuel in a fuel inlet passage, preventing a pressure loss at a start end of a pump flow passage to prevent generation of a local negative pressure, thereby increasing pump efficiency. The turbine fuel pump includes an impeller with blades and blade grooves, and a pump housing having first and second housings for rotatably storing the impeller. The first housing has a C-shaped side groove, a fuel inlet passage which bends at a start end of the side groove toward the center of the first housing, and an opening on an outer side surface. The second housing has a C-shaped side groove, and a fuel outlet opening communicating with a terminal end of the side groove.

16 Claims, 8 Drawing Sheets

TURBINE FUEL PUMP

CROSS REFERENCE TO RELATED APPLICATION

This application is based upon, claims the benefit of priority of, and incorporates by reference, the contents of Japanese Patent Applications No. 2001-232749 filed Jul. 31, 2001 and No. 2002-124745 filed Apr. 25, 2002.

BACKGROUND OF THE INVENTION

1. Field of the Invention

The present invention relates to a turbine fuel pump for pressure-feeding fuel from a fuel tank to a fuel injection apparatus on a vehicle.

2. Description of the Related Art

A turbine fuel pump may be used for pressure-feeding fuel in a fuel tank to a fuel injection apparatus on a vehicle such as an automobile. The turbine fuel pump (also referred to as a "Westco pump") generally includes a disk-shaped impeller having multiple blades and blade grooves alternately formed along the circumference on an outer peripheral surface of the impeller, a motor housing that has C-shaped pump flow passages communicating to the blade grooves and that also stores the rotating impeller, and a motor for driving the impeller.

There have been needs for increasing the efficiency of a fuel supply apparatus including a fuel pump in view of decreasing fuel consumption of vehicles and atomizing fuel for low emissions. For these purposes, the shape of the blades and the blade grooves of the impeller, and the shape of a fuel outlet opening to which a terminal end of a pump flow passage of the motor housing communicates, have been improved.

However, a smooth flow of fuel at a fuel inlet opening, with which a start end of the pump passage of the motor housing communicates, has not been sufficiently studied. For example, in a turbine fuel pump in FIG. 12 and FIG. 13 (see Japanese Patent Laid-Open Publication No. Hei. 11-117890), a motor housing 120 is attached to a pump housing 135, and comprises a pump cover 122 on one side (a bottom side) 131 of the impeller 130, and a pump casing 126 on the other side (a top side) 132 of the impeller 130.

The pump cover 122 and the pump casing 126 form a circular impeller storage space, and a C-shaped pump flow passage 125. A fuel inlet opening 123 is formed on the pump cover 122 for communicating to a start end 125*a*. A fuel outlet opening 127 is formed on the pump casing 126 for communicating to a terminal end 125*b* of the pump flow passage 125. The impeller 130 has multiple blades 133 and blade grooves 134 alternately formed on an outer periphery, and is stored in the impeller storage space. The blade grooves 134 communicate to the pump flow passage 125.

The fuel inlet opening 123 passes through the pump cover 122 in the axial direction (in the vertical direction in FIG. 12). Thus, the flow direction of the fuel drawn from the fuel inlet opening 123 into the start end 125*a* is orthogonal to the rotational direction of the impeller 130, and is orthogonal to the flow direction of the fuel in the pump flow passage 125. The direction of the fuel flow changes by almost a right angle at the start end 125*a*.

As a result, the flow rate of the fuel decreases at the start end 125*a*, and a loss of pressure (a pressure loss) is generated in the fuel. Consequently, a local negative pressure is generated in the fuel pressure at the start end 125*a*, a part of the fuel is vaporized, and the flow quantity decreases accordingly in the pump flow passage 125. Especially when the temperature of the fuel is high, the local negative pressure increases the effect of vaporizing the fuel, and the flow quantity of the fuel markedly decreases.

Then, the flow quantity of the pressure-fed fuel from the start end 125*a* to the terminal end 125*b* decreases, and the outlet quantity from the fuel outlet opening 127 decreases. Thus, problems such as the pump efficiency scarcely increases, and the pump performance decreases when the fuel temperature is high.

SUMMARY OF THE INVENTION

The present invention was devised in view of the above problems, and an object is to provide a turbine fuel pump for preventing a pressure loss at the start end of the pump flow passage and for preventing the accompanying resultant local negative pressure. Additionally, increasing pump efficiency and overall operating performance while at a high temperature is a goal.

The present inventor studied a constitution of a first housing where a direction of drawing the fuel at the start end of the side groove on the inlet side is not orthogonal to the rotational direction of the impeller, and is not orthogonal to the fuel flow direction in the side groove on the inlet side. As a result, such an idea as the fuel inlet opening not being made as a port (an opening) but as a fuel inlet passage having a predetermined length was devised resulting in completion of the present invention.

A turbine fuel pump of a first aspect of the present invention includes a disk-shaped impeller provided with multiple blades and multiple blade grooves formed alternately around a circumference on a first surface and on an outer periphery of the second surface, and a pump housing for storing the impeller during rotation.

The pump housing includes a disk-like first housing provided on a first side of the impeller, and a disk-like second housing provided on a second side of the impeller. The first housing includes a side groove on an inlet side, and a fuel inlet passage. The side groove on the inlet side is formed on an inner side surface of the first housing, and extends from a start end to a terminal end in approximately a C-shape.

The fuel inlet passage extends from the start end of the side groove on the inlet side toward the inside in the radial direction, and simultaneously toward the terminal end, and has an opening on an outer side surface of the first housing. The second housing includes a side groove on an outlet side, and a fuel outlet opening. The side groove on an outlet side is formed on an inner side surface of the second housing, and extends from a start end to a terminal end in approximately a C-shape. The fuel outlet opening communicates to the terminal end of the side groove on the outlet side. The impeller rotates to increase the pressure of fuel while the fuel drawn from the fuel inlet passage is being transported to the fuel outlet opening.

In this fuel pump, the fuel inlet passage extends from the start end toward the terminal end of the side groove on the inlet side, and has the opening on the outer side surface. Thus, the fuel flowing from the fuel inlet passage to the start end is not orthogonal to the fuel flow in the side groove on the inlet side, and is not orthogonal to the rotational direction of the impeller. As a result, the decrease of the flow rate when the inlet fuel merges is small, the loss of the pressure is prevented at the start end, and the inlet fuel smoothly merges with the fuel in the side groove on the inlet side.

Additionally, since a centrifugal force is applied to the fuel in the fuel inlet passage, the fuel flow rate increases.

A turbine fuel pump of an eleventh aspect of the present invention includes a disk-shaped impeller provided with multiple blades and multiple blade grooves formed alternately in the circumferential direction on a first surface and on a second surface around an outer periphery. Additionally, a pump housing is provided for storing said rotating impeller. The pump housing includes a disk-like first housing provided on one side of the impeller, and a disk-like second housing provided on the other side of the impeller.

The first housing includes a side groove on an inlet side, and a fuel inlet passage. The side groove on the inlet side is formed on an inner side surface of the first housing, and extends from a start end to a terminal end in approximately a C-shape. The fuel inlet passage extends from the start end of the side groove on the inlet side to an opening on an outer side surface of the first housing. The opening is positioned on the inside of the start end in the radial direction, and simultaneously on a side close to the terminal end in the circumferential direction.

The second housing includes a side groove on an outlet side in approximately a C-shape formed on an inner side surface thereof, and a fuel outlet opening communicating to a terminal end of the side groove on the outlet side. The impeller rotates to increase a fuel pressure while the fuel drawn from the fuel inlet passage is being transported to the fuel outlet opening.

In this fuel pump, the opening on the outer side surface of the first housing is placed on the inside of the start end in the radial direction, and on a side close to the terminal end in the circumferential direction. Thus, the fuel flowing from the fuel inlet passage to the start end is not orthogonal to the fuel flow in the side groove on the inlet side and the rotational direction of the impeller. As a result, the decrease of the flow rate when the inlet fuel merges is small, the loss of the pressure is prevented at the start end, and the inlet fuel smoothly merges with the fuel in the side groove on the inlet side. Additionally, because a centrifugal force is applied to the fuel in the fuel inlet passage, its flow rate increases.

In turbine fuel pumps of second and twelfth aspects, the fuel inlet passage extends linearly in the turbine fuel pumps as in the first and eleventh aspects. With these fuel pumps, the fuel flows smoothly in the fuel inlet passage.

In turbine fuel pumps of third and thirteenth aspects, the fuel inlet passage is tilted or angled with respect to a tangent of the start end in a plan view of the inner side surface of the first housing in the turbine fuel pumps of the second and twelfth aspects. With these fuel pumps, the fuel inlet direction is not orthogonal to the fuel flow in the side groove on the inlet side. Thus, the flow rate does not sharply decrease at the start end, and the loss of pressure is prevented.

In turbine fuel pumps of the fourth and fourteenth aspects, the fuel inlet passage is tilted with respect to a bottom surface of the side groove on the inlet side in a section in the axial direction of the turbine fuel pump as in the turbine fuel pumps of the second and twelfth aspects. With these fuel pumps, the inlet direction of the fuel is not orthogonal to the rotational direction of the impeller. Thus the flow rate does not sharply decrease at the start end, and the fuel smoothly flows into the blade grooves.

In turbine fuel pumps of the fifth and fifteenth aspects, the length of the inlet passage is twice to four times the thickness of the first housing in the turbine fuel pumps of the first and eleventh aspects. With these fuel pumps, since the fuel inlet passage is not too long, the pressure loss is small while the fuel is flowing through the fuel inlet passage.

In a turbine fuel pump of a sixth aspect, the fuel inlet passage includes a tilted groove that is tilted with respect to the bottom surface of the side groove on the inlet side, which gradually increases its depth, and a through hole tilted with respect to the tilted groove, and having an opening on the outer side surface of the first housing in the turbine fuel pump of the fourth aspect. With this fuel pump, the fuel smoothly flows through the fuel inlet passage.

In a turbine fuel pump of a seventh aspect, a boundary between the fuel inlet passage and the side groove on the inlet side is rounded as in the turbine fuel pumps of the fourth aspect. With this fuel pump, the fuel flows even more smoothly through the fuel inlet passage.

In a turbine fuel pump of an eighth aspect, the side groove on the inlet side includes an inner side groove and an outer side groove concentrically formed as in the turbine fuel pump of the first aspect. A start end of the inner side groove and a start end of the outer side groove are formed in the fuel inlet passage. With this fuel pump, the flow quantity of the pressure-fed fuel is doubled to increase the pump efficiency, and simultaneously, the one fuel inlet passage is shared by the two side grooves on the inlet side.

In a turbine fuel pump of a ninth aspect, the impeller includes multiple communication holes passing from one surface to another surface inside the multiple blades and the multiple blade grooves in the radial direction on one surface and on the other surface as in the turbine fuel pump of the first aspect. With this fuel pump, since the fuel flows through the communication holes at the start end and the terminal end of the pump flow passage, it is not necessary to form communication parts in the first housing and the second housing.

In a turbine fuel pump of a tenth aspect, a first communication part is formed on the outer peripheral side of the start end of the side groove on the inlet side in the turbine fuel pump of the first aspect. A second communication part is formed on the outer peripheral side of the terminal end of the side groove on the inlet side. A third communication part is formed on the outer peripheral side of the start end of the side groove on the outlet side. A fourth communication part is formed on the outer peripheral side of the terminal end of the side groove on the outlet side. The first communication part communicates to the third communication part, and the second communication part communicates to the fourth communication part. With this fuel pump, since the fuel flows through the first to fourth communication parts of the pump housing on the start end and the terminal end of the pump flow passage, it is not necessary to form communication holes on the impeller.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Figure 1:
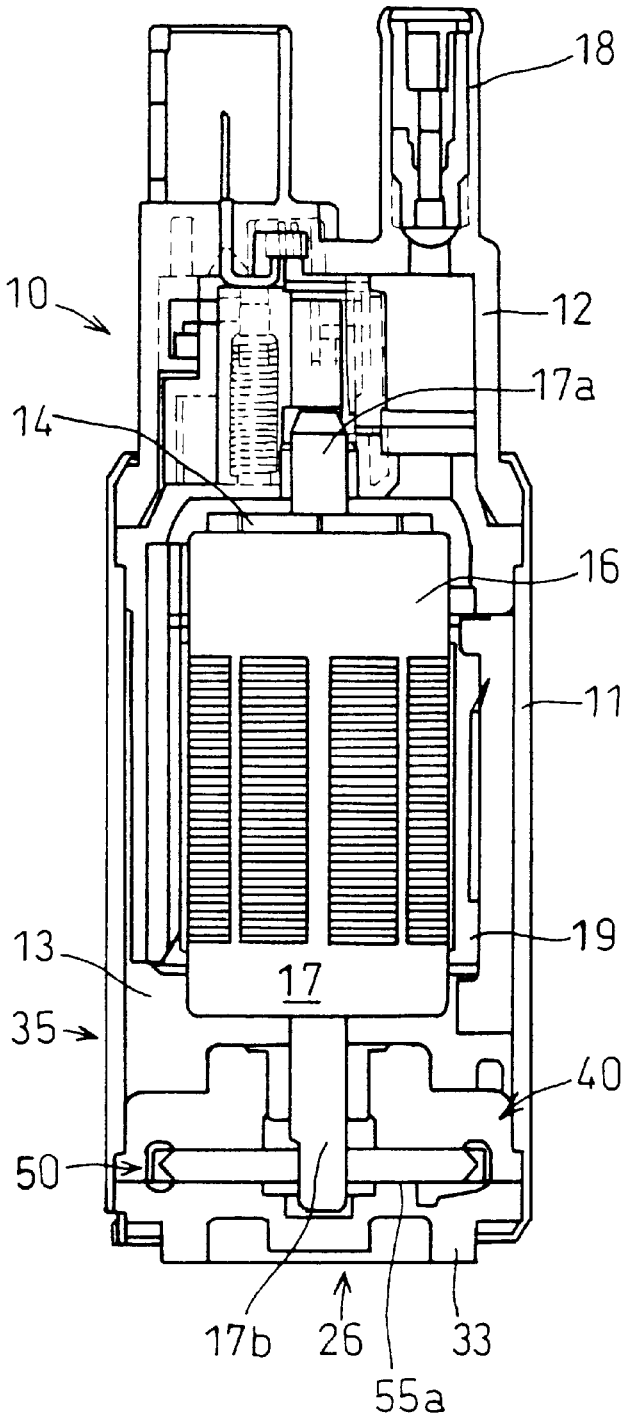
FIG. 1 is a front sectional view showing a turbine fuel pump of a first embodiment of the present invention.

The following description of the preferred embodiments is merely exemplary in nature and is in no way intended to limit the invention, its application, or uses.

Impeller

The drawings show an impeller that has a disk-like shape. The first and second housings guide both side surfaces of the impeller at the center. On its outer periphery, partitions extending in the radial direction and the circumferential direction are formed. On a first side surface and on a second side surface, multiple blades and multiple blade grooves are alternately formed in the circumferential direction.

There is no restriction on the specific shape and the number of rows of the blades and blade grooves. For example, the blade grooves on the first side surface may be formed opposite the same positions of the blade grooves on the second side surface in the circumferential direction. Or the blade grooves on the one side surface may be displaced (formed staggeredly) with respect to the blade grooves on the other side surface. The blades on the one side surface and the other side surface may extend parallel to the axis of the impeller, or they may be angled with respect to the axis.

The impeller may have multiple communication holes passing in the axial direction through a part inside in the radial direction of the blades and the blade grooves on the one side surface and on the other side surface. These communication holes serve as communication passages from the start end of the side groove on the inlet side to the start end of the side groove on the outlet side. They also serve as communication passages from the terminal end of the side groove on the inlet side to the terminal end of the side groove on the outlet side.

Pump Housing (1) The following section describes a pump housing that has an overall disk shape. The pump housing includes a disk-shaped first housing (a pump cover) on the one side of the impeller, and a disk-shaped second housing (a pump casing) on the other side of the impeller. The pump cover and the pump casing may have approximately symmetric storage shapes, or the pump cover may be a disk shape and the pump casing may be a storage shape. In either case, the first housing and the second housing define an impeller storage space in a flat disk shape and the pump flow passage in approximately a C-shape extending from a start end to a terminal end.

The "approximately C-shape" means a shape which curves from the start end to the terminal end, and the start end and the terminal end are slightly separated in the circumferential direction. The curvature of the "approximately C-shape" may be constant or may not be constant. When the curvature of the pump flow passage is constant, it may continue almost half way around or almost completely around.

(2) First Housing

The following section describes the first housing. A side groove on an inlet side extends from a start end to a terminal end in the approximately C-shape, and is formed on the inner side surface along the outer periphery of the first housing. There is no specific restriction on the sectional shape and the number of the side groove on the inlet side.

In the first housing, a fuel inlet passage extends from the start end of the side groove on the inlet side to an opening on the outer side surface, and this passage is directed toward the inside in the radial direction, and simultaneously toward the terminal end. More specifically, the fuel flow passage is formed in a region enclosed by an extension in the tangential direction at the start end, and a line connecting the start end of the side groove on the inlet side and the center of the first housing in a plan view of the inner side surface of the first housing. The relative position of the opening with respect to the start end determines the tilt direction of the fuel inlet passage in the plan view, and the tilt angle and length of the fuel inlet passage in the sectional view in the axial direction of the fuel pump.

In terms of the tilt direction, for example, when the opening is placed inside the start end in the radial direction, and simultaneously on the terminal end side on the extension, the passage bends at the start end toward the center, and forms acute angles with respect to the extension and the connection line. When the opening is too close to the extension, the direction of the fuel flow greatly changes. When the opening is too close to the connection line, the distance to the terminal end is too short, and seal capability between the start end and the terminal end decreases.

The tilt angle of the fuel inlet passage with respect to the bottom surface of the side groove on the inlet side has a close relationship with the length of the fuel inlet passage in the first housing as shown in the axial cross section. When the tilt angle is large, the length becomes small. When the tilt angle is small, the length becomes large. The tilt angle can be an acute angle, and the length can be twice to four times of the thickness of the first housing.

The fuel inlet passage may extend linearly, may curve, or may bend between the start end and the opening. For example, the fuel inlet passage may comprise a through hole and a tilted groove. The through hole has a predetermined first acute angle with respect to the inner side surface of the first housing or an extension of the side groove on the inlet side, and passes through the pump cover. The tilted groove has a predetermined second acute angle smaller than the first acute angle with respect to the inner side surface of the first housing (the pump cover), and connects the side groove and the through hole with each other.

The sectional area of the fuel flow passage may be constant or may change gradually between the start end and the opening. Further, it is preferred that a boundary between the fuel flow passage and the side groove on the inlet side be rounded.

A first communication part may be formed on the outer peripheral side of the start end of the side groove on the inlet side, and a second communication part may be formed on the outer peripheral side of the terminal end of the side groove on the inlet side.

Second Housing

The following section describes the second housing. An approximately C-shaped side groove on an outlet side is formed along the outer peripheral edge of the inner side surface of the second housing. There is no restriction on the sectional shape and the number of the side groove on the outlet side. However, the number is the same as that of the side groove on the inlet side. There is no restriction on the constitution of a fuel outlet opening.

A third communication part communicating to the first communication part may be formed on the outer peripheral side of the start end of the side groove on the outlet side. A fourth communication part communicating to the second communication part may be formed on the outer peripheral side of the terminal end of the side groove on the outlet side. When the impeller does not have the communication holes for the fuel, the fuel flows from the side groove on the inlet side to the side groove on the outlet side through the first communication part and the third communication part at the start end of the pump flow passage. Also, the fuel flows from the side groove on the inlet side to the side groove on the outlet side through the second communication part and the fourth communication part at the terminal end of the pump flow passage.

First Embodiment

The following describes a first embodiment of the present invention while referring to FIG. 1 to FIG. 5.

In FIG. 1, a turbine fuel pump is roughly separated into an upper motor part 10 and a lower pump part 35.

Constitution (1) Motor Part

The motor part 10 includes a motor housing 11 and an armature 16. A motor cover 12 is attached to the upper end of the cylindrical motor housing 11 with openings on both ends. Brushes (not shown) are integrated into the motor cover 12, and slidingly contact with a commutator 14 of the armature 16. An outlet opening 18 is provided on the motor cover 12. A pump casing 40 and a pump cover 26 described later are attached to the bottom end of the motor housing 11.

A motor room 13 is formed between the motor cover 12 and the pump casing 40. The armature 16, including the commutator 14, is placed in the motor room 13. The motor cover 12 rotatingly supports a top end part 17*a* of a shaft 17 of the armature 16. The pump cover 26 rotatingly supports a bottom end part 17*b* thereof. A pair of magnets 19 are fixed to an inner side surface of the motor housing 11.

(2) Pump Part

The pump part 35 includes a pump housing 38 and an impeller 50. The pump housing 38 has a pump casing 40 and a pump cover 26.

Figure 2:
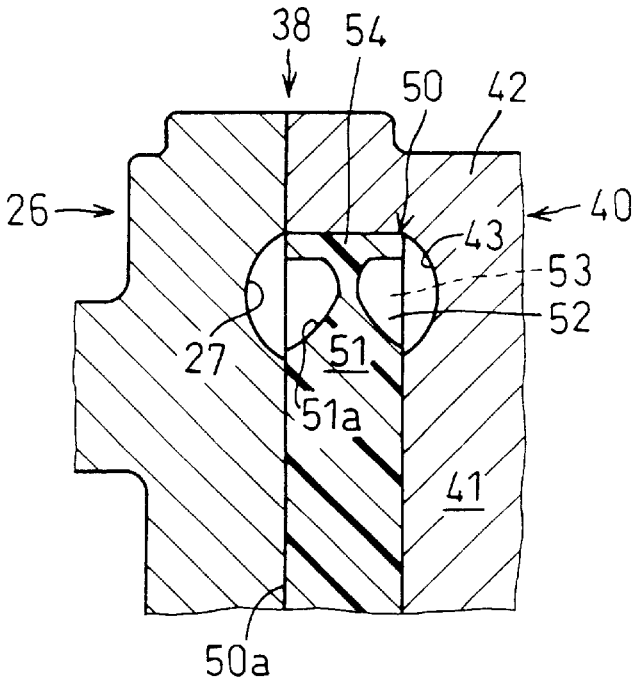
FIG. 2 is an enlarged view of a principal part of FIG. 1.
Figure 3B:
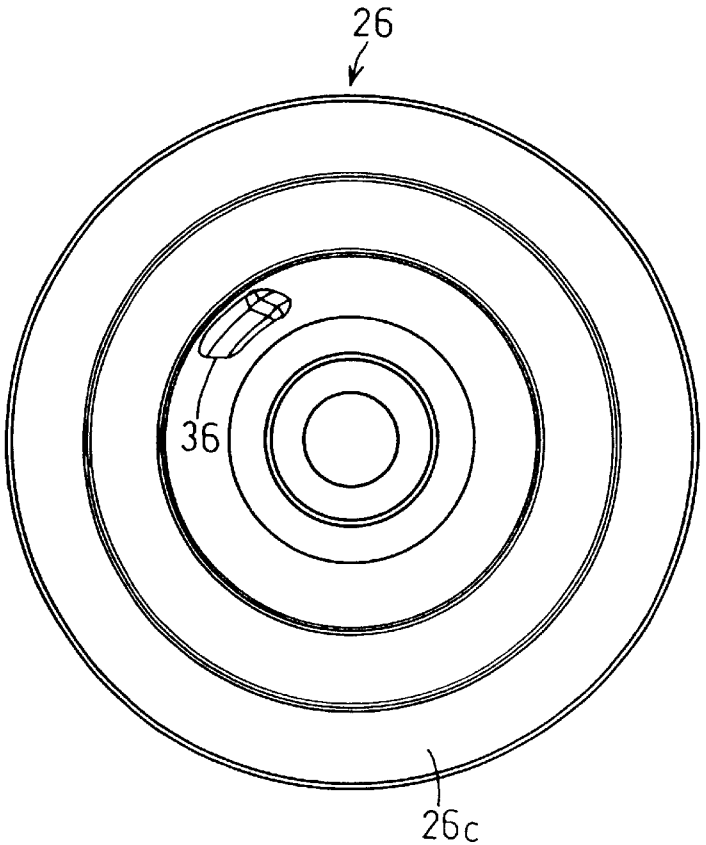
FIG. 3B is a plan view of the pump cover as seen from the outside.

As shown in FIG. 2 and FIG. 3, the overall pump cover 26 has a disk shape. A C-shaped side groove 27 is formed along the outer peripheral edge on an inner side surface 26*a* of the pump cover 26. The side groove 27 extends from a start end 28 to a terminal end 29. A first communication groove 31 is formed on the outer peripheral side of the start end 28. A second communication groove 32 is formed on the outer peripheral side of the terminal end 29. The first and second communication grooves 31 and 32 have a predetermined length in the circumferential direction and the axial direction, and a predetermined depth in the radial direction.

A fuel inlet passage 33 communicates with the start end 28. The fuel inlet passage 33 extends from the start end 28 to an opening 36 on an outer side surface 26*c*. The opening 36 is positioned on the inside with respect to the start end 28 in the radial direction, and on the opposite side with respect to the start end 28 in the circumferential direction. The opening 36 is separated from the start end 28 by about three times the thickness of the pump cover 26. As a result, in a plan view of the inner side surface 26*a* of the pump cover 26, the fuel inlet passage 33 has an acute angle θ1 (about 50°) with respect to a tangent (t) passing through the start end 28 (more specifically, an extension line in the tangential direction at the start end 28). The fuel inlet passage 33 has an acute angle (90°-θ1) with respect to a normal (n) passing through the start end 28 (more specifically, a line connecting the start end 28 and a center 26*b* with each other). Thus, the fuel inlet passage 33 extends from the start end 28, and bends toward the center 26*b* of the pump cover 26.

Figure 4:
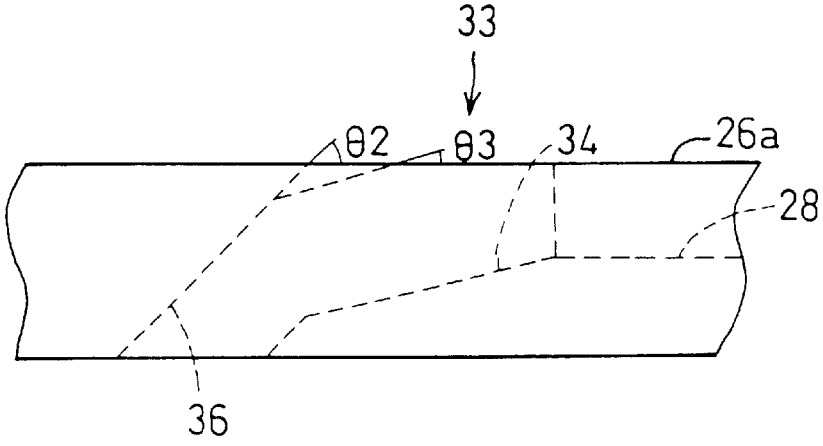
FIG. 4 is a sectional view taken along the line 4—4 in FIG. 3A.
Figure 3A:
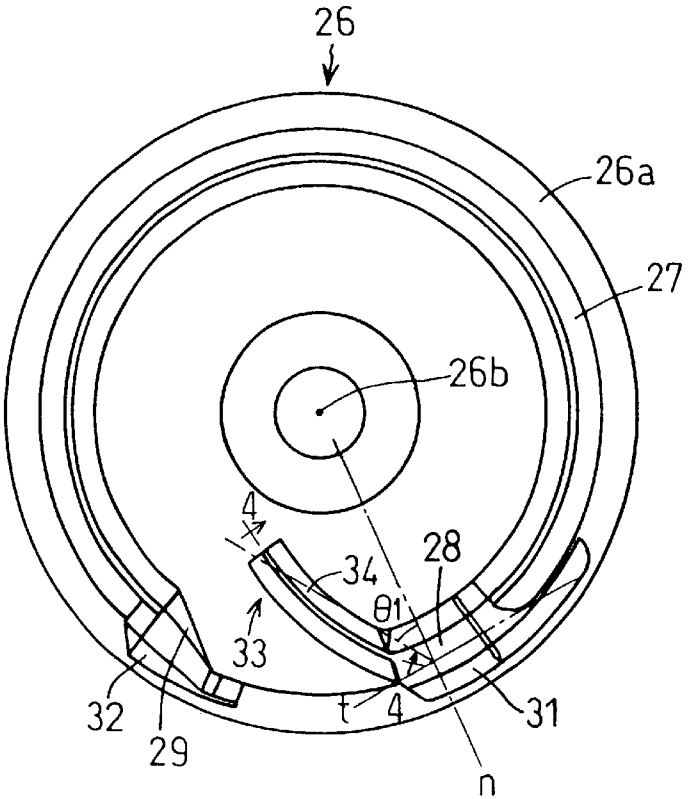
FIG. 3A is a plan view of the pump cover of the first embodiment as seen from the inside.

The fuel inlet passage 33 has a predetermined acute angle (about 20° to 25°) with respect to the inner side surface 26*a* of the pump cover 26 in a section in the axial direction (the thickness direction) of the pump cover 26. Namely, the fuel inlet passage 33 obliquely passes through the pump cover 26 at an angle of about 70° with respect to the axial direction. More specifically, as shown in FIG. 3A and FIG. 4, the fuel inlet passage 33 has a through hole 36 and a tilted groove 34. The through hole 36 has a first predetermined acute angle θ2 (about 25°) with respect to the inner side surface 26*a* of the pump cover 26, passes from the inner side surface 26*a* to the outer side surface 26*c*, and has an opening on the outer side surface 26*c*. The tilted groove 34 has a second predetermined acute angle θ3 (about 20°) with respect to the bottom surface of the side groove 27, and gradually increases its depth from the inner side surface 26*a*, where the acute angle θ3 is smaller than the acute angle θ2. The tilted groove 34 smoothly connects the side groove 27 and the through hole 36 with each other. The side groove 27 and the tilted groove 34 form a C-shaped pump passage.

Figure 5B:
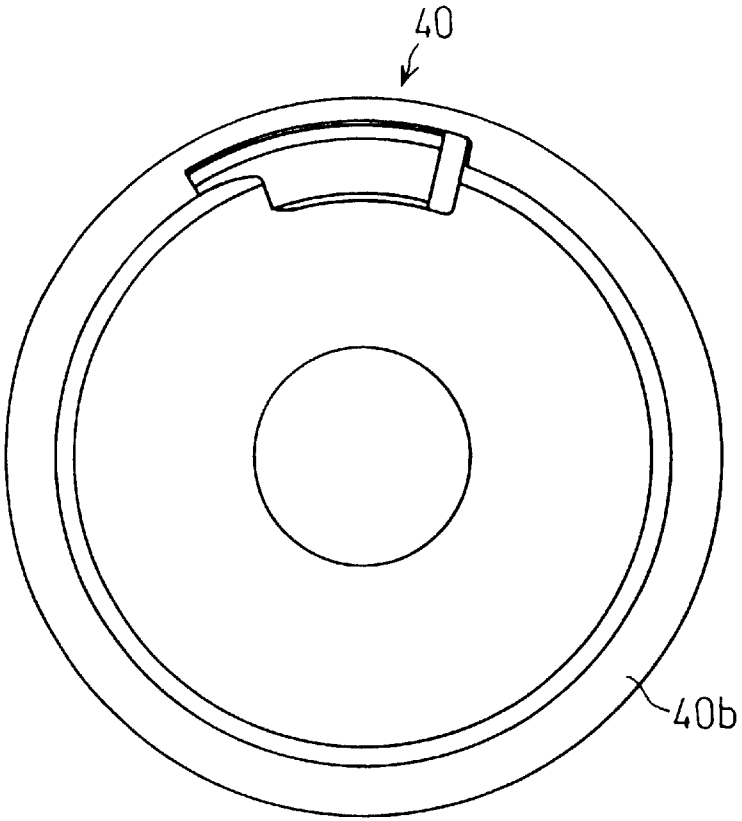
FIG. 5B is a plan view of the pump casing as seen from the outside.
Figure 5A:
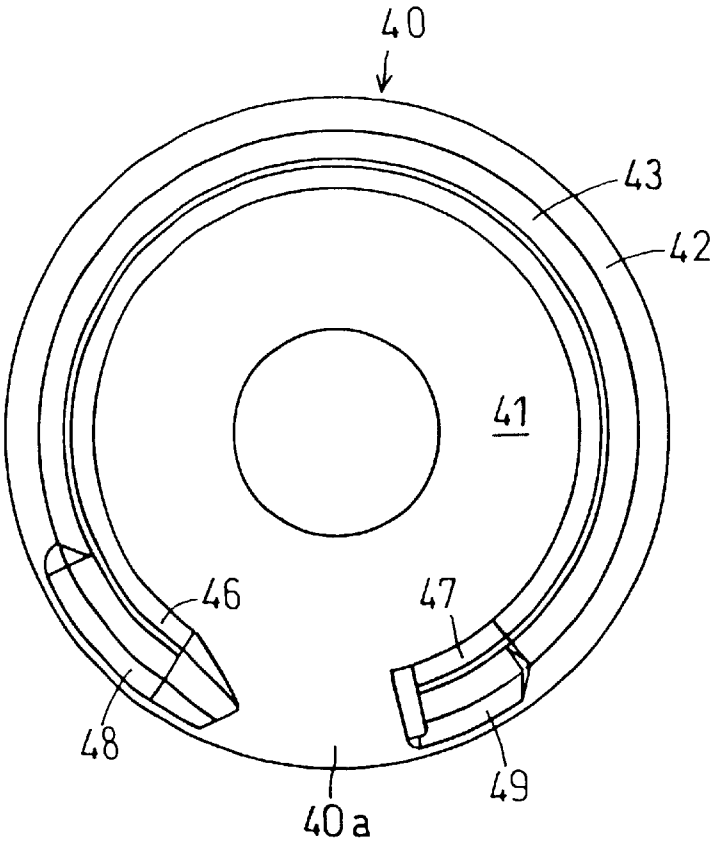
FIG. 5A is a plan view of a pump casing of the first embodiment as seen from the inside.

As shown in FIG. 2 and FIGS. 5A and 5B, the pump casing 40 takes a storage shape which includes a bottom wall 41 and a circumferential wall 42 around the bottom wall 41. A side groove 43 is formed along the outer peripheral edge of the bottom wall 41, and has the same C-shape as the side groove 27. The side groove 43 extends from a start end 46 to a terminal end 47. A third communication groove 48 is formed on the outer peripheral side of the start end 46. A fourth communication groove 49 is formed on the outer peripheral side of the terminal end 47. The third and fourth communication grooves 48 and 49 have a predetermined length in the circumferential direction and the axial direction, and a predetermined depth in the radial direction. The third communication groove 48 communicates to the first communication groove 31. The fourth communication groove 49 communicates to the second communication groove 32.

A fuel outlet opening (not shown) communicates to the terminal end 47, passes through the pump casing 40 parallel with the axis, and has an opening on an outer side surface 40*b*. The fuel outlet opening communicates to the pump room 13 (See FIG. 1).

(3) Impeller

The following describes the impeller 50. As shown in FIG. 2, the impeller 50 is disk-shaped. Multiple blades and blade grooves 52 are alternately formed in the circumferential direction at the outer periphery on one side and the other side of a partition wall 51. An annular part 54 is provided on the outer peripheral surface of the partition wall 51. The impeller 50 is stored in a storage space of the pump housing 38 for rotation. The blade grooves 52 communicate to the side grooves 27 and 43.

Action and Effect

The following describes the action and effects of the first embodiment. When electrical power is supplied for the motor part 10, and the armature 16 rotates, the impeller 50 attached to the bottom end part 17*b* of the shaft 17 rotates counterclockwise in FIG. 3A. As a result, the fuel is drawn through the fuel inlet passage 33, and circulates through the side grooves 27 and 43 from the start ends 28 and 46 to the terminal ends 29 and 47 in a spiral manner. The pressure of the fuel increases accordingly.

Namely, the fuel flows into the blade grooves 53 from the inner peripheral side, and flows through the blade groove 53 outward in the radial direction under a centrifugal force generated by the rotation. Then, the fuel collides with the outer peripheral wall 42, and is separated into left and right flows. The left and right flows flow through the left and right side grooves 27 and 43 inward in the radial direction, and flow into the blade groove 53 following in the rotation direction. The fuel repeats this action, and the pressure of the fuel increases. The fuel flows into the motor room 13 from the fuel outlet opening in this pressurized state, and is discharged into a fuel supply line through the outlet opening 18.

The following section details the flow of the fuel in the fuel inlet passage 33. The fuel flows into the start end 28 of the side groove 27 through the through hole 36 and the tilted groove 34. The through hole 36 and the tilted groove 34 form an acute angle (about 25°) with respect to the inner side surface 26*a* of the pump cover 26, and this acute angle is much smaller than a right angle. The fuel flows inside the blade grooves 52 at this acute angle with respect to a side surface 50*a* of the impeller 50. Then, the fuel is guided by a side surface of the partition wall 51, and flows through the blade groove 52 outward in the radial direction.

The fuel inlet passage 33 forms an acute angle with respect to the extension in the tangential direction at the start end 28, and has an acute angle with respect to the line connecting the start end 28 and the center 26*b* with each other in a plan view of the inner side surface 26*a* of the pump cover 26. The fuel inlet passage 33 is separated from the center 26*b* by a predetermined distance. The angled directions of the through hole 36 and the angled groove 34 are close to the direction of the side surface 51*a* of the partition wall 51. The change in the direction of the fuel flow decreases compared with that of the conventional fuel flow when the fuel flows into the side groove 27. As a result, the pressure loss at the start ends 28 and 46 decreases, and the generation of local negative pressure is prevented. The flow rate of the fuel is increased by the centrifugal force when the fuel flows through the fuel inlet passage 33. As a result, a decrease of the flow rate at the start end 28 is prevented.

Second Embodiment

Constitution

A second embodiment of the present invention will be described with reference to FIG. 6 to FIG. 10. The first section describes the constitution of the second embodiment. The second embodiment is mainly different from the first embodiment in the constitution of an impeller 60 and the constitution of a pump cover 80 (especially a fuel inlet passage 85). The other constitutions of the first and the second embodiments are the same, and the following section mainly describes the different parts.

Figure 6:
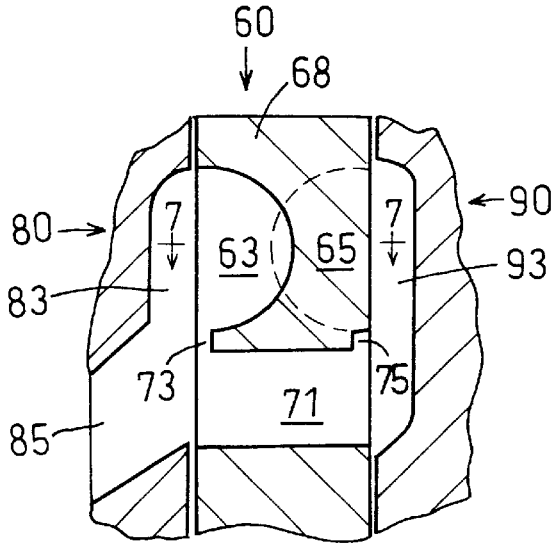
FIG. 6 is a vertical cross-sectional view of a principal part showing a turbine fuel pump of a second embodiment of the present invention.
Figure 7:
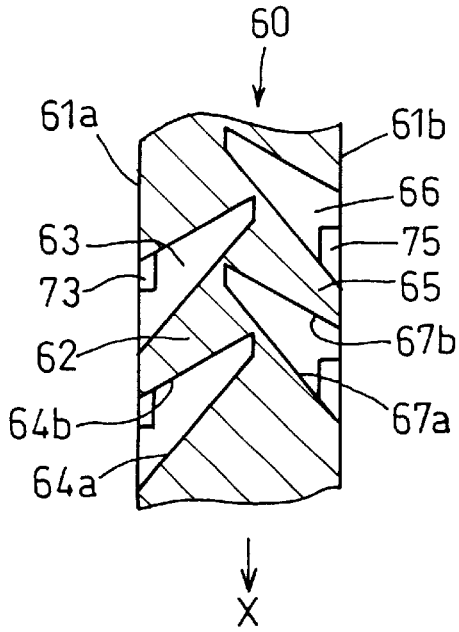
FIG. 7 is a vertical cross-sectional view taken along the line 7—7 in FIG. 6.
Figure 10:
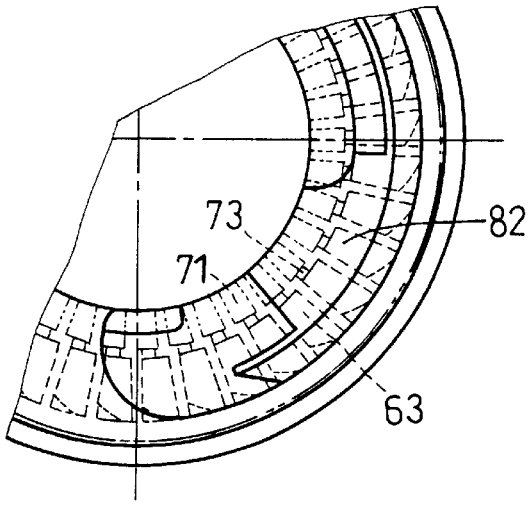
FIG. 10 is a descriptive plan view showing a relationship between the pump cover and an impeller of the second embodiment.

As FIG. 6, FIG. 7, and FIG. 10 show, blades 62 and blade grooves 63 are alternately formed in the circumferential direction on one side 61*a* of the impeller 60. Blades 65 and blade grooves 66 are formed in the circumferential direction on the other side 61*b* of the impeller 60 in the same way. As a result, an outer peripheral annular part 68 is formed.

The blade grooves 63 are shifted with respect to the blade grooves 66 in the circumferential direction by a distance corresponding to half of the pitch at which these blades are formed. As shown in FIG. 7, the blade grooves 63 and 66 are angled such that an innermost side is backward with respect to an entrance side in the rotational direction X of the impeller 60. In other words, the entrance side is forward with respect to the innermost side. The tilt angle of front wall surfaces 64*a* and 67*a* is larger than the tilt angle of the rear wall surfaces 64*b* and 67*b*. As a result, the dimensions of the blade grooves 63 and 66 in the circumferential direction gradually decrease from the entrance side to the innermost side on a section which is parallel with the axis, and passes through a middle of the blade grooves 63 and 66 in the radial direction.

Further, the blade grooves 63 extend toward the opposite side surface 61*b* beyond the center of the impeller 60 in the axial direction. In the same way, the blade grooves 66 extend toward the opposite side surface 61*a* beyond the center of the impeller 60 in the axial direction. As a result, as shown in FIG. 6, the innermost part of the blade groove 63 and the inner most part of the blade groove 66 overlap each other in the axial direction in a section of the impeller.

As shown in FIG. 6 and FIG. 10, communication holes 71, as many as there are blade grooves 63 and 66, are formed inside the blade grooves 63 and 66 in the radial direction. The individual communication holes 71 pass through from the first side surface 61*a* to the second side surface 61*b*, and have a rectangular section longer in the radial direction.

Shallow grooves 73 and 75 are respectively formed inside the blade grooves 63 and 66 in the radial direction on the first side surface 61*a* and the second side surface 61*b*. The shallow grooves 73 and 75 are displaced by a distance corresponding to ¼ of the forming pitch of the blade grooves 63 and 66 with respect to the blade grooves 63 and 66 in the circumferential direction. With this structure, the blade grooves 63 on the first side surface 61*a* communicate to the blade grooves 66 on the second side surface 61*b* through the shallow grooves 73, the communication holes 71, and the shallow grooves 75.

Figure 8A:
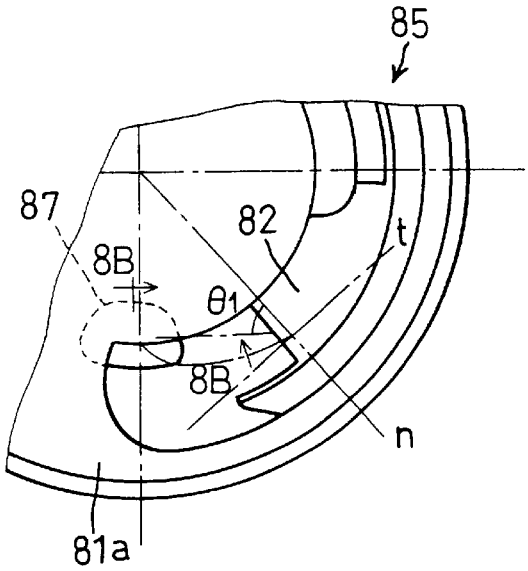
FIG. 8A is a plan view of a pump cover of the second embodiment as seen from the inside.
Figure 9:
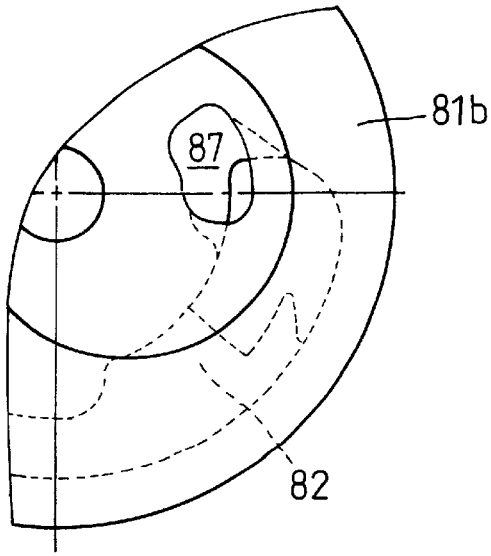
FIG. 9 is a plan view of a pump casing of the second embodiment as seen from the outside.

As shown in FIG. 8A and FIG. 9, a side groove 85 extending from a start end 82 to a terminal end 83 in approximately a C-shape (see FIG. 6), and a fuel inlet passage 88 extending from the start end 82 to an opening 87 on an outer side surface 81*b* are formed on an inner side surface 81*a* of a pump cover 80. As shown in FIGS. 6–7, the length in the radial direction (the width) of the side groove 85 is approximately equal to the sum of the lengths of the blade grooves 63 and 66 of the impeller 60 in the radial direction, and the length of the communication hole 71 in the radial direction.

Figure 8B:
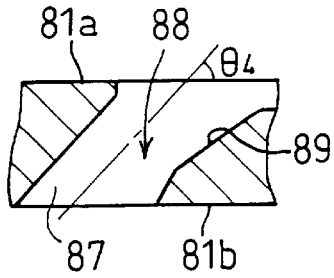
FIG. 8B is a cross-sectional view taken along line 8—8 in FIG. 8A.

As shown in FIGS. 8A and 8B, the fuel inlet passage 88 has the same acute angle θ1 with respect to an extension in the tangential direction at the start end 82, and the line connecting the start end 82 and the center of the pump cover 80 with each other in the plan view of the inner side surface 81*a* of the pump cover 80 as the fuel inlet passage 33 of the first embodiment (FIG. 3A). The fuel inlet passage 88 is angled in the same direction as the fuel inlet passage 33. In the present embodiment, the distance between the start end 82 and the opening 87 is shorter than that in the first embodiment (about a half). As a result, as shown in FIG. 8B, the length of the fuel inlet passage 88 is shorter than the fuel inlet passage 33.

An angle θ4 of the fuel inlet passage 88 with respect to the inner side surface 81*a* of the pump cover 80, namely the bottom surface of the side groove 85 on the inlet side, is larger than the tilt angles θ2 and θ3 in the first embodiment. Further, a gentle slope 89 smaller in tilt angle than the other parts is formed on a boundary between the fuel inlet passage 88 and the start end 82 of the side groove 85.

The first communication groove 31 and the second communication groove 32 (see FIG. 3A) in the first embodiment are not formed on the outer peripheral side of the start end 82 and the terminal end 83 of the side groove 85.

A pump casing 90 has a constitution similar to that of the pump casing 40 of the first embodiment. However, the third communication groove 48 and the fourth communication groove 49 in the first embodiment are not formed on the outer peripheral side of a start end (not shown) and a terminal end 93 of a side groove.

Action and Effect

The following section describes the action and effects of the second embodiment. In the second embodiment, the tilt angle θ4 of the fuel inlet passage 88 in the pump cover 80 is larger than that in the first embodiment, and the length of the fuel inlet passage 88 is shorter. As a result, the time and the distance of the fuel flow in the fuel inlet passage 88 are shorter, and the pressure loss decreases accordingly.

Also the blade grooves 63 and 66 extend beyond the center in the axial direction, and overlap in the axial direction. As a result, an effective volume is secured for increasing the momentum of the fuel flowing through the blade grooves 63 and 66, and the pump efficiency increases.

Further, a part of the fuel flowing into the start end 82 of the side groove 85 from the fuel inlet passage 88 of the pump cover 80 flows to the start end of the side groove of the pump casing 90 through the shallow groove 73, the communication hole 71 and the shallow groove 75 of the impeller 60. Then, the fuel is transported to the terminal end 93 of the side groove by the blade groove 66 of the impeller 60, and is pressurized. The fuel flows to the terminal end 83 of the side groove (fuel inlet passage) 85 through the shallow groove 75, the communication hole 71, and the shallow groove 73.

Because the communication holes 71, and the shallow grooves 73 and 75 for communicating the blade grooves 63 and 66 to each other are formed on the impeller 60, the fuel flowing through the communication holes 71 is prevented from moving the impeller 60 in either direction in the radial direction.

Modified Embodiment

Figure 11:
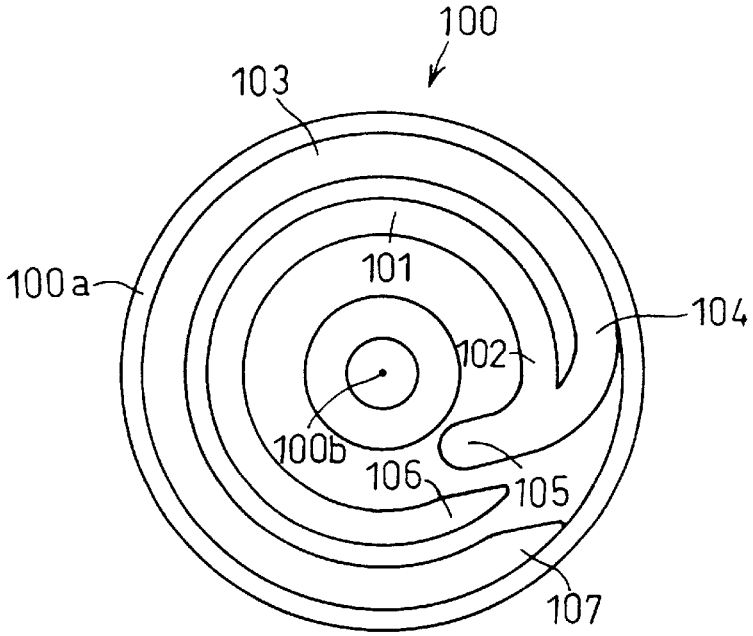
FIG. 11 is a plan view of a principal part showing a modification of the first embodiment.
Figure 12:
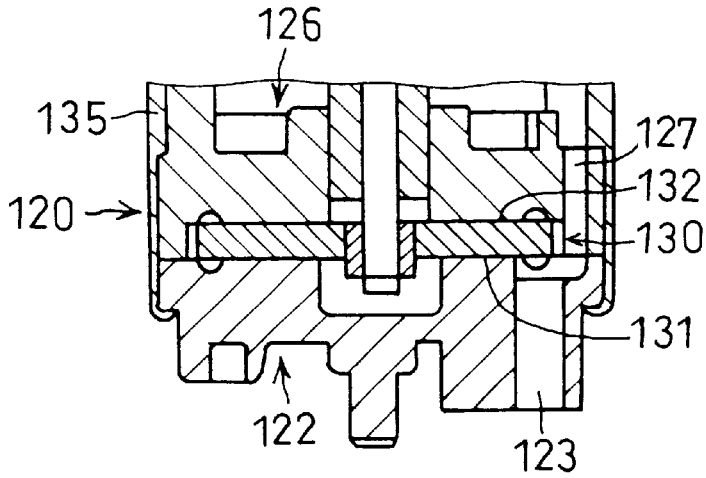
FIG. 12 PRIOR ART
FIG. 12 is a front cross-sectional view of a principal part showing a conventional turbine fuel pump.
Figure 13:
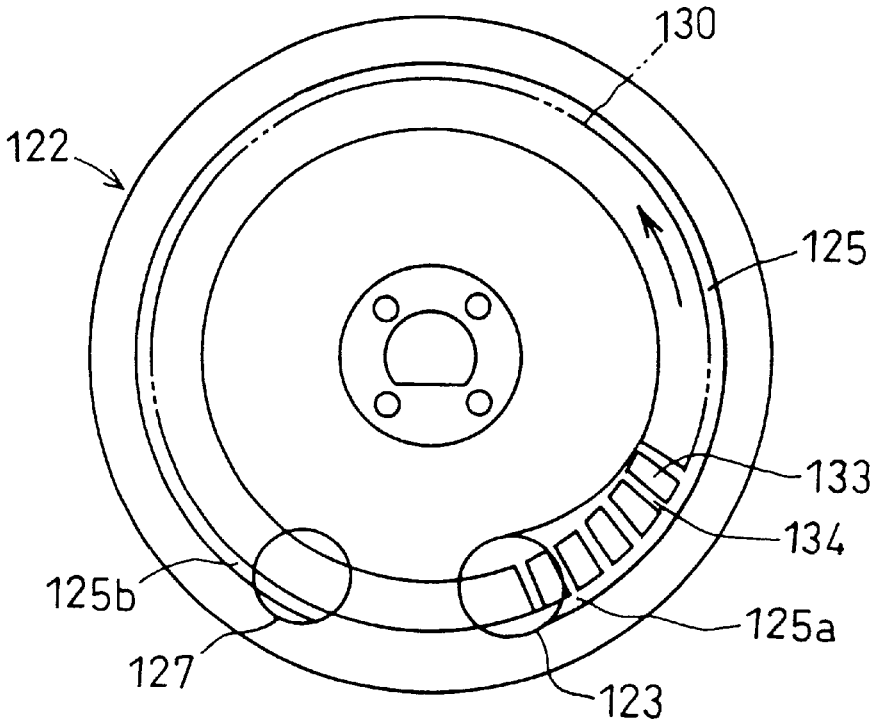
FIG. 13 PRIOR ART
FIG. 13 is a plan view of a pump cover of the conventional turbine fuel pump as seen from the inside.

The following describes a modification of the embodiment. Two concentric side grooves 101 and 103 in a C-shape are formed on an inner side surface of a pump cover 100 in a modified embodiment shown in FIG. 11. A start end 102 of the inner side groove 101 and a start end 104 of the outer side groove 103 communicate with a fuel inlet passage 105. The fuel inlet passage 105 bends by a predetermined acute angle with respect to the tangent at the start end 102 of the inner side groove 101, and extends toward the center 100*b* of the pump cover 100.

The terminal end 106 of the inner side groove 101, and the terminal end 107 of the outer side groove 103 respectively communicate to a fuel outlet opening (not shown). Two side grooves are formed on a pump casing (not shown). Blades and blade grooves on an inner peripheral side, and blades and blade grooves on an outer peripheral side are formed on an impeller (not shown).

In this modified embodiment, the fuel flows into the start end 102 of the inner side groove 101, and the start end 104 of the outer side groove 103 through the fuel inlet passage 105 having a small acute angle with respect to an inner side surface 100*a* of the pump cover 100. Then, the fuel flows into the blade grooves at this angle with respect to a surface on one side of the impeller 50 (see FIG. 2).

In this modified embodiment, the fuel inlet passage 105 communicates to, namely is shared by, both the start end 102 of the inner side groove 101, and the start end 104 of the outer side groove 103. Since the two side grooves 101 and 103 for the outside and the inside are formed on the pump cover 100, the pump efficiency increases.

As described above with the turbine fuel pumps of the first and second embodiments, the fuel flowing from the fuel inlet passage to the start end is not orthogonal to the rotational direction of the impeller, and is not orthogonal to the fuel flow direction in the blade grooves on the inlet opening side. As a result, the decrease of the flow rate is small when the fuel is merged, and the pressure loss at the start end is prevented. Consequently, a local negative pressure is not generated. Thus, such effects as the pump efficiency and high temperature performance increases are provided. In addition, the flow rate of the fuel in the fuel inlet passage increases due to the centrifugal force, and simultaneously, the fuel from the fuel inlet passage smoothly merges with the fuel in the blade grooves on the inlet side.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A turbine fuel pump comprising:

a disk-shaped impeller provided with multiple blades and multiple blade grooves formed alternately in a circumferential direction on a first surface and on a second surface of an outer periphery of the impeller; and a pump housing for housing said impeller for rotating, the pump housing comprising:

a disk-like first housing provided on said first side of said impeller, said first housing comprising:

a side groove on an inlet side formed on an inner side surface and extending from a start end to a terminal end in approximately a C-shape; and a fuel inlet passage extending from the start end of said side groove on said inlet side toward an inside in a radial direction, and simultaneously toward said terminal end, and having an opening on an outer side surface;

a disk-like second housing provided on said second side of said impeller, said second housing comprising:

a side groove on an outlet side formed on an inner side surface, and extending from a start end to a terminal end in approximately a C-shape; and a fuel outlet opening communicating with the terminal end of said side groove on an outlet side, said impeller rotating to increase a pressure of fuel while the fuel drawn from said fuel inlet passage is being transported to said fuel outlet opening.

2. The turbine fuel pump according to claim 1, wherein said fuel inlet passage extends linearly.

3. The turbine fuel pump according to claim 2, wherein said fuel inlet passage is angled with respect to a tangent of said start end.

4. The turbine fuel pump according to claim 2, wherein said fuel inlet passage is angled with respect to a bottom surface of said side groove on the inlet side in an axial direction of the turbine fuel pump.

5. The turbine fuel pump according to claim 3, wherein a length of said fuel inlet passage is twice to four times a thickness of said first housing.

6. The turbine fuel pump according to claim 4, wherein said fuel inlet passage includes an angled groove angled with respect to the bottom surface of said side groove on the inlet side, gradually increasing in depth, a through hole angled with respect to said angled groove, and an opening on the outer side surface of said first housing.

7. The turbine fuel pump according to claim 4, wherein a boundary between said fuel inlet passage and said side groove on the inlet side is rounded.

8. The turbine fuel pump according to claim 1, wherein said side groove on the inlet side includes an inner side groove and an outer side groove concentrically formed, and a start end of said inner side groove and a start end of said outer side groove are formed in said fuel inlet passage.

9. The turbine fuel pump according to claim 1, wherein said impeller includes multiple communication holes passing from said first surface to said second surface, inside said multiple blades and said multiple blade grooves, in the radial direction on said first surface and on said second surface.

10. The turbine fuel pump according to claim 1, wherein a first communication part is formed on an outer peripheral side of said start end of said side groove on the inlet side, a second communication part is formed on an outer peripheral side of the terminal end of said side groove on the inlet side, a third communication part is formed on an outer peripheral side of the start end of said side groove on the outlet side, a fourth communication part is formed on an outer peripheral side of the terminal end of said side groove on the outlet side, said first communication part communicates to said third communication part, and said second communication part communicates to said fourth communication part.

11. A turbine fuel pump comprising:

a disk-shaped impeller provided with multiple blades and multiple blade grooves formed alternately in the circumferential direction on a first surface and on a second surface about an outer periphery; and a pump housing for storing said impeller, said pump housing comprising:

a disk-like first housing provided on a first side of said impeller, said first housing including a side groove on an inlet side formed on an inner side surface and extending from a start end to a terminal end in approximately a C-shape, and a fuel inlet passage extending from said start end of said side groove on the inlet side to an opening on an outer side surface, said opening positioned on the inside of said start end in a radial direction, and simultaneously on a side close to said terminal end in the circumferential direction, and a disk-like second housing provided on a second side of said impeller, said second housing including a side groove on an outlet side in approximately a C-shape formed on an inner side surface, and a fuel outlet opening communicating to a terminal end of said side groove on the outlet side, wherein said impeller rotates to increase a pressure of fuel while the fuel drawn from said fuel inlet passage is being transported to said fuel outlet opening.

12. The turbine fuel pump according to claim 11, wherein said fuel inlet passage extends linearly between the start end of said side groove on the inlet side and the opening on said outer side surface.

13. The turbine fuel pump according to claim 12, wherein said fuel inlet passage is angled with respect to a tangent of said start end in a plan view of the inner side surface of said first housing.

14. The turbine fuel pump according to claim 12, wherein said fuel inlet passage is angled with respect to a bottom surface of said side groove on the inlet side in an axial direction of the turbine fuel pump.

15. The turbine fuel pump according to claim 13, wherein a length of said inlet passage is twice to four times a thickness of said first housing.

16. The turbine fuel pump according to claim 14, wherein a length of said inlet passage is twice to four times a thickness of said first housing.

* * * * *